US006676466B1

(12) United States Patent
Glen

(10) Patent No.: US 6,676,466 B1
(45) Date of Patent: Jan. 13, 2004

(54) FAST POST-IMMERSON RESTART SYSTEM FOR A MARINE PROPULSION UNIT

(75) Inventor: Robert D. Glen, Bicester (GB)

(73) Assignee: EP Barrus Limited, Oxfordshire (GB)

( * ) Notice: Subject to any disclaimer, the term of this patent is extended or adjusted under 35 U.S.C. 154(b) by 0 days.

(21) Appl. No.: 09/959,485

(22) PCT Filed: May 2, 2000

(86) PCT No.: PCT/GB00/01523

§ 371 (c)(1),
(2), (4) Date: Feb. 15, 2002

(87) PCT Pub. No.: WO01/20146

PCT Pub. Date: Mar. 22, 2001

(30) Foreign Application Priority Data

Apr. 29, 1999 (GB) ..... 9909947
Nov. 4, 1999 (GB) ..... 9926137

(51) Int. Cl.[7] ..... B63H 21/10
(52) U.S. Cl. ..... 440/88 R
(58) Field of Search ..... 123/575, 576, 123/182–1; 440/88, 89

(56) References Cited

U.S. PATENT DOCUMENTS 1,429,017 A * 9/1922 Cartmill
2,922,436 A * 1/1960 Brash ..... 123/182.1
3,132,635 A 5/1964 Heidner
3,750,639 A 8/1973 DiGirolamo
3,783,849 A 1/1974 Bramfitt
4,300,517 A 11/1981 Astansky et al.
4,461,250 A 7/1984 Mohr
4,676,759 A 6/1987 Murase
4,911,116 A 3/1990 Prohaska et al.
5,181,488 A * 1/1993 Sakurai ..... 123/179.11
5,632,659 A 5/1997 Martin et al.

FOREIGN PATENT DOCUMENTS

EP 0 219 278 A2 4/1987
EP 0 773 356 A2 5/1997

* cited by examiner

*Primary Examiner*—Ed Swinehart
(74) *Attorney, Agent, or Firm*—Arent Fox Kintner Plotkin & Kahn, PLLC

(57) ABSTRACT

A marine propulsion unit comprises a cylinder (1), a combustion chamber (2) extending from one end of the combustion chamber, a spark plug (8) provided in the combustion chamber (2), and a piston (5) mounted for reciprocating movement within the cylinder (1).

A first port (9) is provided in the combustion chamber (2), and this is selectively openable independent of the position of the piston (5) within the cylinder (1). If the propulsion unit should be immersed in water so that the cylinder becomes flooded, the cylinder can be purged by opening the port (9) and moving the piston (5) so as to expel water through the port (9). Once all water has been expelled further movement of the piston causes gases in the cylinder to pass over the spark plug thus removing trapped water from the spark plug without the need to remove the spark plug from the engine to dry it. The location of the first port is chosen so as to maximise as far as possible the flow of gas over the spark plug (8), to minimise the time taken to remove trapped water from the spark plug. Once the spark plug has been dried sufficiently to allow ignition to be achieved, the propulsion unit can be restarted.

A second port (10) can also be provided to improve drainage of the engine.

24 Claims, 2 Drawing Sheets

FIG 1
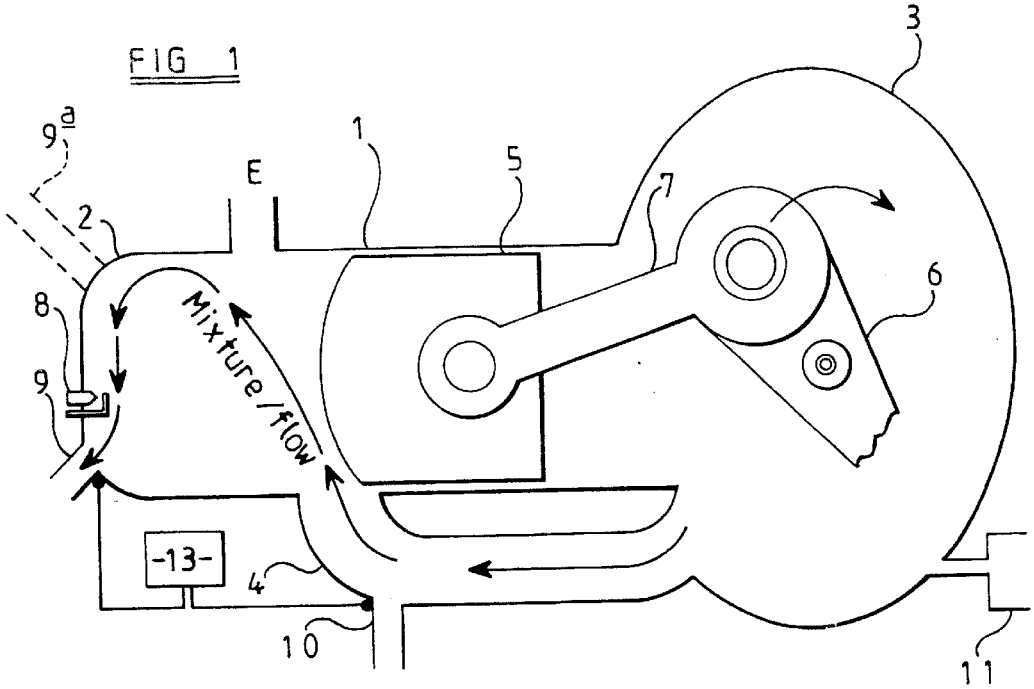
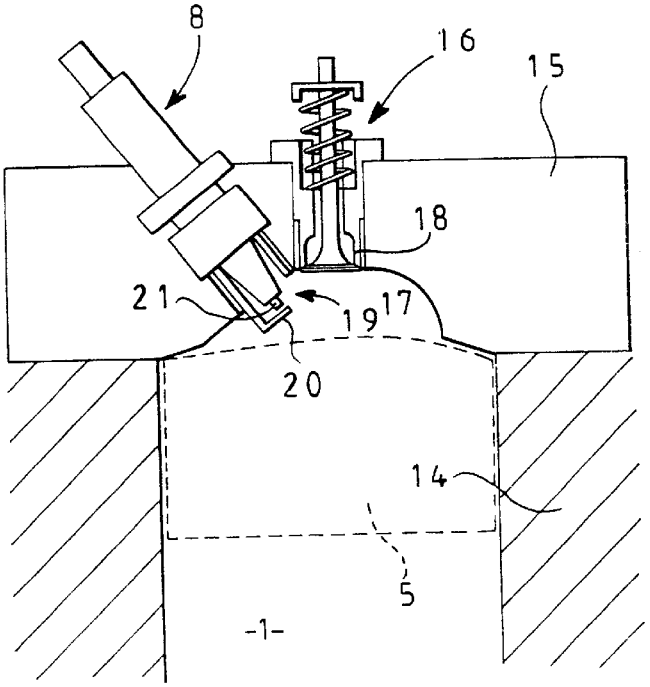
FIG 2

FAST POST-IMMERSON RESTART SYSTEM FOR A MARINE PROPULSION UNIT

The present invention relates to a marine propulsion unit. In particular, it relates to a marine propulsion unit, for example, such as an outboard motor, that can be restarted as soon as possible after the engine has been flooded with water. The present invention also relates to a method of purging a marine propulsion unit that has been flooded with water.

A propulsion unit, such as an internal combustion engine, for a land vehicle is normally not designed in any way for contact with, or immersion in, a body of water. Should such immersion occur as a result of an accident, the engine will stop, become flooded with water, and will need specialist attention before it can be restarted.

It is not unknown for boats fitted with small motors, such as outboard motors, to capsize. This can happen, for example, on a rescue mission, if the boat is swamped by breakers when the boat is working close in shore. Alternatively, when a rescue vessel is approaching another vessel, it is possible for waves to be re-directed by the vessel that requires rescue and these can swamp the rescue vessel. Furthermore, when a rescue vessel is launched into heavy seas it is possible for the boat to be capsized upon launch. When the vessel capsizes the motor will be submerged, and water will flood into the engine.

Even in the case of a vessel provided with a self-righting capability, the engine is generally flooded with water by the time the vessel has righted itself. Water will inevitably enter the engine, even though mercury gravity switches are provided to switch off the engine once a predetermined angle of roll is reached.

There have been attempts to provide water-proof internal combustion engines, for vehicles required to have full on-land/in-water capability such as tanks. A fully waterproofed engine is, however, expensive. Furthermore, maintenance of such engines is complicated, since great care must be taken during maintenance if the waterproofing is to be maintained.

The present invention, therefore, does not aim to prevent ingress of water into a marine propulsion unit. Instead, it is directed to an engine that can be restarted as soon as possible after it has been flooded with water.

It is known to provide a marine propulsion unit with an openable drain port, to allow water to be drained after the vessel has been righted. However, when an engine is flooded, water will enter all parts of the engine and in particular tends to lodge in the spark plugs. The provision of a drain port in the propulsion unit will not assist in removing water trapped in the spark plugs, and the water trapped in the spark plugs will make it impossible to achieve ignition and restart the propulsion unit.

For example, European Patent EP-B-0 219 278 describes a carburettor fitted with a drainage system. While the drainage system of EP-B-0 219 278 enables water to be drained from the carburettor this is not sufficient to allow the engine to be restarted, the drainage system will not be able to remove water trapped in the spark plugs. It is necessary to remove the spark plugs and either dry them or replace them with new spark plugs before the engine can be restarted. This is very difficult to do in a small boat in heavy seas.

A first aspect of the present invention provides a marine propulsion unit comprising: a cylinder; a combustion chamber extending from a first end of the cylinder; a spark plug disposed within the combustion chamber; and a piston reciprocably movable within the cylinder; wherein the unit further comprises a first aperture, the first aperture being selectively openable independent of the position of the piston within the cylinder, the first aperture being positioned such that, in its open state, movement of the piston causes gas within the propulsion unit to flow over the spark plug thereby to remove water from the spark plug.

When a propulsion unit or the present invention is flooded, the unit can be purged of water simply by opening the first aperture and turning over the unit (either manually or using the starter motor if the unit is provided with one). The movement of the piston will expel water from the unit through the first aperture.

The first aperture of a marine propulsion unit of the present invention is, however, not solely a drain port. In contrast to the prior art drain ports, which are positioned at the lowest point of the engine to provide effective drainage, the first aperture of a propulsion unit of the invention is positioned such that a flow path of gas to the first aperture will pass over the points of the spark plug. Thus, according to the invention, once all water has been expelled, continued movement of the piston will cause gas within the propulsion unit to flow over the contacts of the spark plug. This flow of gas over the spark plug will remove water trapped in the spark plug while the spark plug is in situ. Once enough of the trapped water has been removed from the spark plug to enable ignition to be achieved and so allow the propulsion unit to be restarted, the first aperture is closed. The propulsion unit can then be restarted.

The present invention thus provides a post-immersion restart system that does not require the spark plug to be removed for drying or replacement. Since there is no need to remove the spark plug, the present invention makes restarting much faster, and also much easier to carry out.

The first aperture is preferably positioned to maximise the flow of gas over the spark plug when the first aperture is open, as far as the structural constraints of the engine allow this. This minimises the time taken to remove trapped water from the spark plug.

In a preferred embodiment of the invention, the propulsion unit further comprises an openable second aperture, the second aperture being positioned such that, in its open state, movement of the cylinder causes fluid within the propulsion unit to pass out of the propulsion unit through the second aperture.

Providing the second aperture enables the time needed to purge the propulsion unit to be reduced. Water in the propulsion unit can be expelled through the second aperture, and will not be transferred to the combustion chamber and come into contact with the spark plug.

The second aperture is preferably disposed at substantially the most effective drainage point of the marine propulsion unit, in order to provide the most efficient drainage.

A second aspect of the invention provides an outboard motor comprising a marine propulsion unit as defined above.

A third aspect of the present invention provides a method of determining the location of the first aperture of a marine propulsion unit of the type defined above.

A fourth aspect of the present invention provides a method of purging a marine propulsion unit as defined in claim 18.

A fifth aspect of the present invention provides a method of re-starting a marine propulsion unit as defined in claim 22.

A sixth aspect of the present invention provides a method of starting a marine propulsion unit as defined in claim 23.

Further preferred features of the invention are set out in the other dependent claims.

A preferred embodiment of the present invention will now be described by way of illustrative example with reference to the accompanying Figures, in which:

FIG. 1 is a schematic sectional view of a marine propulsion unit according to the present invention;

FIG. 2 is a schematic sectional view of a cylinder head of a marine propulsion unit according to the present invention;

Figure 3:
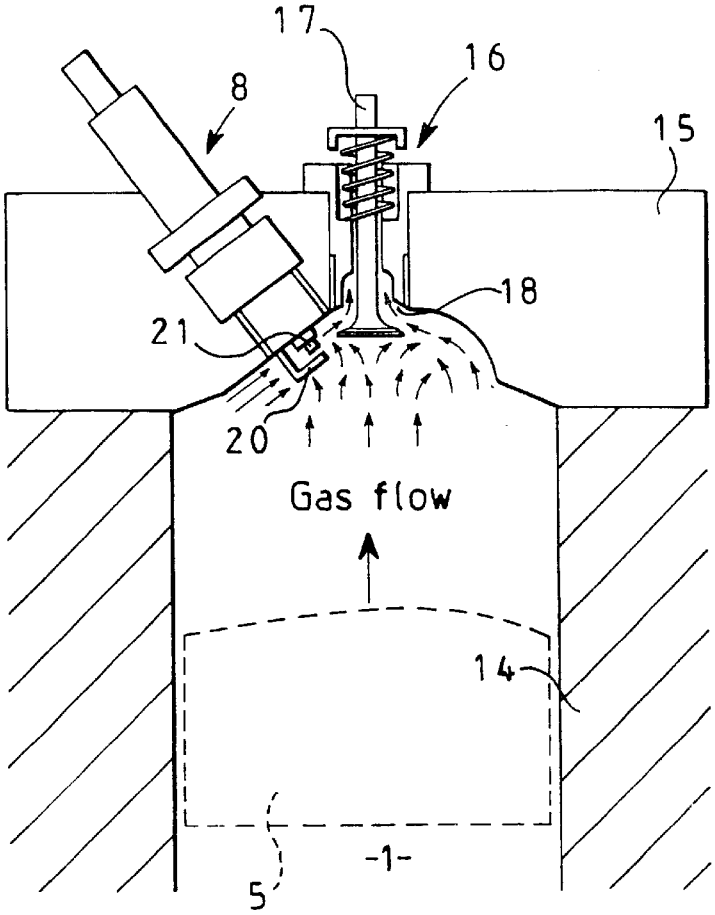
FIG. 3 is a schematic sectional view of the cylinder head of a marine propulsion unit according to the present invention illustrating the flow of gas over the spark plug.

The marine propulsion unit shown in FIG. 1 is a two-stroke internal combustion engine. Only one cylinder 1 is shown in FIG. 1 for clarity and ease of explanation, although the propulsion unit will in general have two or more cylinders.

A combustion chamber 2 is disposed at a first end of the cylinder 1, and a crank-case 3 is disposed at a second end of the cylinder 1. The engine is a crank-case scavenged engine, and a transfer passage 4 connects the crank-case 3 to the combustion chamber 2.

The propulsion unit shown in FIG. 1 is arranged with the cylinder being generally horizontal, and with the transfer passage 4 being disposed underneath the cylinder 1. The present invention, however is not limited to an engine having this particular orientation.

A piston 5 is disposed within the cylinder, and can move reciprocably within the cylinder. A crank-shaft 6 is disposed within the crank-case 3, and the piston 5 is connected to the crank-shaft 6 by a connecting rod 7, so that reciprocating motion of the piston 5 is converted into rotary motion of the crank-shaft 6.

In use, fuel and air are introduced into the crank-case from the carburettor 11 by inlet means (not shown) such as a conventional reed valve. When the end of the transfer port nearer the combustion chamber is open, the air/fuel mixture passes from the crank-case 3 through the transfer passage 4 into the combustion chamber 2. When the piston 5 moves towards the combustion chamber (to the left in FIG. 1) it will close the entry to the transfer passage, and subsequent movement of the piston towards the combustion chamber will compress the fuel/air mixture. The mixture is then ignited by one or more spark plugs 8 provided in the combustion chamber (only one spark plug is shown in FIG. 1 for clarity, but more than one spark plug could be provided), and the resultant combustion of the fuel/air mixture drives the piston 5 away from the combustion chamber 2. An exhaust port E allows the combustion products to exhaust from the cylinder when it is uncovered by the piston.

As so far described, the construction of the propulsion unit is entirely conventional.

The propulsion unit of FIG. 1 is provided with a purging system according to the present invention. The purging system shown in FIG. 1 essentially consists of two ports provided in the propulsion unit. A first port 9 is provided in the combustion chamber and a second port 10 is provided in the transfer passage 4. These ports are additional to the exhaust port E, and they are selectively and independently openable regardless of the position of the piston 5 in the cylinder 1. The ports are shown in their open states in FIG. 11, but in normal operation of the propulsion unit both ports will be closed. The first and second ports may be any conventional ports that can withstand the normal operating conditions of the propulsion unit. It is preferable that the ports do not extend within the transfer passage or the combustion chamber to such an extent as to significantly affect the normal performance of the engine.

The operation of the marine propulsion unit of the invention when it becomes immersed in water will now be described.

When the vessel fitted with the marine propulsion unit capsizes, water will enter the propulsion unit through, for example, the air intake. It is preferable to provide the propulsion unit with switches, such as mercury gravity switches, that turn off the propulsion unit when a given angle of roll of the vessel is reached, but even if such switches are provided they will not completely prevent the ingress of water into the propulsion unit. Thus, when the vessel is righted after a capsize, the propulsion unit will typically be flooded with water. If the unit has stopped with the piston 5 blocking the exhaust port E, it will not be possible for the water to leave the cylinder so that the piston 5 is hydraulically locked and so cannot move within the cylinder 1.

In a multi-cylinder propulsion unit it is possible that the unit will stop with the crank-shaft shaft in a position such that the exhaust port in one cylinder is uncovered. However, if just one cylinder in the unit is hydraulically locked this will lock the entire unit and will prevent it from being re-started.

The first step in the purging process is to open the second port 10 so that the interior of the propulsion unit is vented to atmosphere. Water can then drain out of the unit, in this embodiment through the transfer passage 4 and the second port 10. Subsequent opening of the first port 9 enables release of hydraulic pressure above the piston (that is, from the combustion chamber 2). It is then possible to rotate the crank-shaft 6 and so reciprocate the piston 5 within the cylinder 1, and such movement of the piston 5 will cause water within the propulsion unit to be expelled through the second port 10. The crank-shaft can be rotated either manually or, if the propulsion unit is fitted with a starter motor, using the starter motor.

The second port 10 is preferably provided at the most efficient drainage point of the propulsion unit, to facilitate draining water from within the propulsion unit. In the case of a horizontally arranged propulsion unit having the arrangement shown in FIG. 1, the transfer passage 4 is the lowest part of the propulsion unit and the second port 10 has therefore been positioned in the transfer passage 4. If, however, the engine is oriented such that the transfer passage 4 is not the lowest part of the engine, positioning the second port 10 in the transfer passage will not provide the most efficient drainage. In this case, the second port 4 should be re-positioned to a more efficient drainage point than the transfer passage.

Simply draining the water from the interior of the cylinder 1 is not, however, sufficient to enable the engine to be restarted. This is because water will have become lodged in the contacts of the spark plug when water entered the cylinder, and this water will prevent the spark plug from igniting the fuel/air mixture.

FIG. 2 is a schematic sectional view of the upper part of a cylinder of a marine propulsion unit according to one embodiment of the present invention.

FIG. 2 shows the upper part of the engine block 14 within which the cylinder 1 is defined. A cylinder head 15 is joined to the engine block 14 to complete the cylinder in a conventional manner.

The position of the piston 5 at the uppermost point of its travel is shown in broken lines in FIG. 2. For clarity, a slight gap has been left in the Figure between the exterior of the piston 5 and the interior of the cylinder 1.

A valve 16 is provided in the cylinder head 15 to act as the first port 9. In the embodiment of FIG. 2, the valve is a poppet valve which is spring-loaded so as to be normally closed. The valve can be opened by applying an external force to the valve to move the valve head 17 away from its seating 18 (that is to move the valve head downwards in FIG. 2) so as to open the first port 9.

As FIG. 2 shows, water 19 has become lodged within the contacts 20, 21 of the spark plug 8. This water will short out the contacts, and prevent the spark plug igniting the fuel/air mixture.

According to the invention, the water 19 trapped within the contacts 20, 21 of the spark plug 8 is removed by continuing to reciprocate the piston 5 (as a result of continued rotation of the crank-shaft 6) once water has been drained from the engine. This continued movement of the piston 5 will cause gases within the top of the cylinder to flow over the spark plug, in particular over and into the contacts of the spark plug, thereby removing the trapped water 19 from the spark plug. The flow of gas over the spark plugs that is required to remove the trapped water 19 is obtained by choosing a suitable location for the valve 16 (which forms the first port 9 of FIG. 1).

Consider the operation of a two-stroke engine of the general type shown in FIG. 1. During the down-stroke of the piston 5 (this is to the right in FIG. 1), at some point the piston will block the entrance to the transfer passage 4 from the combustion chamber 2. Once this occurs, gas trapped below the piston will be compressed as the result of further downwards movement of the piston.

Eventually, the downwards movement of the piston will open the entrance to the transfer passage from the combustion chamber. When this happens, compressed gas beneath the piston will pass through the transfer passage into the combustion chamber, and will leave the combustion chamber through the exhaust port E. The flow path of the gas from the transfer passage through the combustion chamber to the exhaust port is complex, and is determined by many factors such as the shape of the combustion chamber, the shape of the top of the piston, and the relative position and orientation of the exhaust port and the transfer passage.

If the first port 9 of the present invention is open, this will affect the flow path of gas in the combustion chamber. Some gas will follow a flow path that leaves the combustion chamber through the first port 9.

At some point in the up-stroke of the piston, the piston will block both the entrance to the transfer passage and the entrance to the exhaust port. In normal operation of the engine, this would lead to compression of gas trapped above the piston. In a marine propulsion unit of the present invention, if the first port 9 is open then the gas trapped above the piston will be able to follow the flow path that leaves the combustion chamber through the first port.

In the present invention the first port 9 is positioned such that, when the first port is open, the flow path of gas to the first port passes over the points of the spark plug. The upstroke of the piston in the cylinder will create a high velocity stream of gas across the spark plug, and the result of this high velocity stream of gas crossing the spark plug is to remove water 19 lodged in the contacts 20, 21 of the spark plug thereby enabling the spark plug to achieve ignition.

Thus, water trapped in the points of the spark plug is removed in the invention by gas flowing over the points of the spark plug. Positioning the first port such that a gas flow with over the spark plug is set tip when the first port is open is very effective at removing water from the points of the spark plug. As a result, an engine of the present invention can be restarted very quickly. In trials it has been found that an engine can be restarted after around 10–15 pulls. Since so few pulls are required, the restart process can be carried out manually, and this is a considerable advantage when attempting to restart the engine of a boat that has capsized.

If the first aperture were positioned such that the flow path of gas to the first aperture does not pass over the points of the spark plug, then the flow of gas will not be effective at removing water from the points of the spark plug and it will be difficult to restart the engine. For example, if the first port in FIG. 1 were located on the other side of the combustion chamber, in the position 9*a* shown in broken lines, there would be no flow of gas over the spark plug and trapped water would not be removed from the spark plug. For this reason prior art drain ports do not set up a gas flow over the spark plug, since the position of these prior art drain ports is dictated solely by the need to provide good drainage of water from the engine.

The spark plug 8 shown in FIG. 2 is a projecting-type spark plug, in that the contacts 20,21 of the spark plug project into the combustion chamber. The principles of the invention apply equally to a marine propulsion unit having a recessed-type spark plug or plugs in which the contacts do not project into the combustion chamber.

In the invention, the preferred location for the first port 9 of FIG. 1 or the valve 16 of FIG. 2 is determined as a result of consideration of the pattern of gas flow above the piston 5. The pattern of gas flow should be determined for the case when the first port 9 or valve 16 is open, since the pattern of gas flow when the first port 9 or valve 16 is closed may well be significantly different.

FIG. 3 shows a typical pattern of gas flow above the piston 5 for the case where the piston 5 is ascending and the valve 16 is open. The location of the valve 16 has been determined so that the flow of gas over the contacts of the spark plug has been substantially maximised, for example by using the process described above. It will be seen that a significant part of the as flow flows around the contacts 21, 22 of the spark plug 8. This will have the effect of removing the water trapped within the contacts of the spark plugs.

When an existing engine is being modified to incorporate a post-immersion restart system of the invention, the size and shape of the combustion chamber, the shape of the upper face of the piston 5, and the size, location and type of the spark plug will already be known. It is therefore straightforward to determine the approximate pattern of gas flow above the piston in the combustion chamber for a given location of the valve 16. Hence, the gas flow across the spark plug 8 can also be determined.

Once the gas flow across the spark plug has been determined for one position of the valve 16, the procedure is repeated for other positions of the valve 16. In this way, the position of the valve 16 that gives the greatest gas flow across the spark plug (and hence that, will provide the most effective removal of water from the spark plug) can be determined.

If the construction of the engine enables the valve 16 to be placed at the position that gives the greatest gas flow across the spark plug, the valve is preferably placed at that position. However, when modifying an existing engine, it is possible that the construction of the engine will make it difficult or impossible to locate the valve 16 at the position that gives the greatest gas flow across the spark plug. In this case, it is necessary to adopt a compromise location for the valve 16. This compromise location should be a location where the construction of the engine makes it possible to position the valve, but which still gives as good a flow of gas as possible over the spark plug when the valve is open.

The principal parameters to be considered when determining the location for the valve 16 are the volume of as flow over the spark plug, and the velocity of flow of the gas over the spark plug. In order to promote rapid drying of the spark plug, it is desirable to make one, and preferably both, of these quantities is large as possible.

Other factors that may affect the flow of the gas over the spark plug are the size, shape and orientation of the first aperture, and also the shape of the combustion chamber in the vicinity of the first aperture. The process described above can be modified to take account of the effect of varying some or all of these factors.

In an engine fitted with a post-immersion restart system of the present invention, once all, or almost all, water has been expelled from the interior of the propulsion unit, continued movement of the piston 5 (as a result of continued rotation of the crank-shaft 6) will then cause gases above the piston 5 to flow across the spark plug 8 before leaving the propulsion unit through the first aperture 9. This flow of gas across the spark plug 8 will remove water lodged in the spark plug so allowing the spark plug to achieve ignition and enabling the engine to be restarted. The present invention thus enables water to be removed from the spark plug 8 in situ, and eliminates the need to remove the spark plug 8 and either dry it or replace it with a fresh spark plug. This greatly simplifies, and also speeds up, the process of purging the engine of water.

Once the spark plug 8 has been dried sufficiently for the engine to be restarted, the first and second ports 9, 10 are closed. The engine can now be restarted.

In an alternative embodiment of the purging process, the first port 9 is opened a pre-set time after the second port 10 has been opened. This can be done either automatically, or manually by opening the second port 10 and waiting a pre-set time before opening the first port 9. The pre-set time will depend on factors such as the make and size of the propulsion unit. It should not be so long that the purging process is prolonged unnecessarily, but it should be sufficient to allow substantially all water within the propulsion unit to be expelled through the second port 10.

In an alternative embodiment of the purging process, the first and second port 9, 10 are opened simultaneously. This embodiment has the advantage that it can easily be carried out, although there is the potential disadvantage that, as explained below with regard to an alternative embodiment in which only the first port 9 is provided, some water could be blown into the spark plug 8 during the purging process.

Control means 13 are provided for opening the first and second ports 9, 10. If it is desired to keep costs to a minimum, the port 9, 10 can be opened and closed using a manual control means. Alternatively, an automatic control means can be used.

When the propulsion unit is immersed in water, water is likely to enter the carburettor 11 as well as the interior of the propulsion unit. It is possible that water in the carburettor could be expelled by turning over the crank-shaft 6 of the propulsion unit for a sufficiently long time. It is, however, preferable to provide the carburettor with its own drainage system, for example a drainage system such as described in European Patent No. 0 219 278.

In the preferred embodiment of the invention illustrated in FIG. 1, the first port 9 is provided in the combustion chamber 2 and the second port 10 is provided at the most efficient drainage point of the engine (in the transfer passage 4 in FIG. 1). In principle, however, it would be possible to provide only the first port 9 in the combustion chamber 2 and not to provide the second port 10. In a propulsion unit provided only with the first port 9, the first port 9 is opened at the start of the purging process to depressurise the engine, and allow water to be expelled through the first port 9 when the crank-shaft 6 is turned over. While this is possible in principle, there is the disadvantage that all water in the engine will be driven past the spark plug 8 before being expelled through the first port 9, and it is possible that this will cause more water to accumulate in the spark plug 8. In consequence, the time taken to purge water from the engine and remove trapped water from the spark plug may be increased.

The propulsion unit illustrated in FIG. 1 has only one first port 9. The invention is not limited to this, however, and it is possible for two or more first ports 9 to be provided. In particular, it may well be preferable to provide a large propulsion unit with two or more first ports, to ensure efficient drying of the spark plug. If two or more first ports are provided, they should again be positioned to maximise the gas flow over the spark plug S (as far as this is possible with regard to any constructional constraints on the location on the ports). Similarly, two or more second ports could be provided.

As noted above, the first port 9 (or first ports if more than one are provided) should be dimensioned and positioned so as to maximise, or at least promote, gas flow over the spark plug 8 in order to dry the spark plug. It has been found that, for an engine having a combustion chamber shaped generally as shown in FIG. 1, the angled arrangement shown in FIG. 1 provides good drying of a spark plug that is centrally located in the combustion chamber. If however, the spark plug 8 is itself at an angle as shown in FIG. 2, then positioning the first port 9 centrally provides a good gas flow over the spark plug. However, the precise location, shape and size required for the port will vary from engine to engine, and must be separately determined for each engine.

In an alternative embodiment of the invention, the first port 9 has an annular form and at least partially surrounds the spark plug 8.

Figure 4:
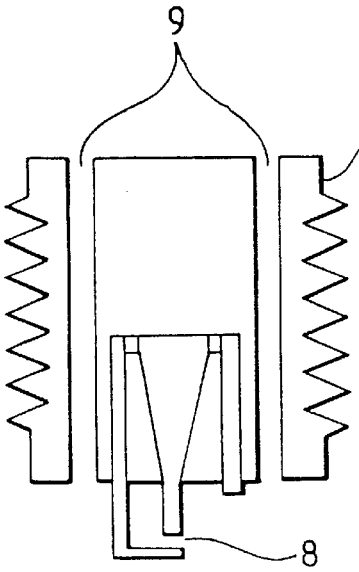
FIG. 4 shows an insert containing a spark plug for use in a marine propulsion unit according to the present invention.

In a related embodiment, shown in FIG. 4, the spark plug 8 and first port 9 are combined in,a single insert 12. In this embodiment, the first aperture 9 is again annular and at least partially surrounds the spark plug 8.

In a preferred embodiment, the external diameter and thread of the insert 12 are chosen to match the normal threaded holes for spark plugs provided in the combustion chamber. This enables a conventional propulsion unit to be modified to the present invention simply by removing the conventional spark plug and replacing it with an insert of the invention that includes both the spark plug and the first port.

Alternatively, the insert 12 can contain a normal size spark plug, and is designed to screw into a large bore threaded hole in the combustion chamber. This embodiment allows the use of a standard spark plug, but means that conversion of a conventional propulsion unit to the present invention would entail enlarging the bore provided in the combustion chamber for receiving the spark plug.

In another aspect of the invention, the second port 10 is not only used for draining the engine after immersion in water, but is also used for introducing fluids or other starting aids into the propulsion unit. In this aspect, the second port 10 is preferably located in the transfer passage 4, even if this is not the lowest point of the propulsion unit. If the transfer passage is not the lowest point, a third selectively openable port (not shown) can be located at the lowest point of the propulsion unit to provide efficient drainage, if desired.

According to this aspect of the invention, re-starting of the propulsion unit after immersion is further facilitated.

Once the engine has been purged of water, and the spark plug dried, a starting aid can be introduced through the second port 10 in order to aid starting the engine.

Injecting fuel or another starting aid through the second port 10 also enables the propulsion unit to run on less volatile fuel. For example kerosene is less volatile than petrol, so that an engine designed to run on petrol will generally not start if kerosene is used as a fuel instead of petrol. Once the engine is running it will continue to run if the fuel is changed from petrol to kerosene, but it will not start on kerosene.

A propulsion unit of the present invention in which the second port 10 is provided in the transfer passage can be adapted to run on fuel that is less volatile than the fuel for which the engine is designed. For example, a propulsion unit designed to run on petrol can be run on kerosene. The unit is started by introducing petrol through the second port 10; when the engine is running, the second port 10 is closed and kerosene is fed to the engine through the carburettor 11.

A propulsion unit according to the present invention can be used as the power unit in an outboard motor.

Although the invention has been described with relation to a single cylinder, for simplicity, the invention can of course be applied to a multi-cylinder engine. When applied to a multi-cylinder engine, it is possible to provide each cylinder with a purging system of the present invention. Alternatively, only some cylinders can be fitted with a purging system, with the other cylinders being fitted with just a pressure relief port to allow water to be expelled.

What is claimed is:

1. A marine propulsion unit comprising: a cylinder; a combustion chamber extending from a first end of the cylinder; a spark plug disposed within the combustion chamber; and a piston reciprocably movable within the cylinder;

wherein the unit further comprises a first aperture, the first aperture being selectively openable independent of the position of the piston within the cylinder, the first aperture being positioned such that, in its open state, movement of the piston causes gas within the propulsion unit to flow over the spark plug thereby to remove water from the spark plug.

2. A marine propulsion unit as claimed in claim 1 wherein the position of the first aperture is selected so as to induce a significant flow of gas over the spark plug when the first aperture is open.

3. A marine propulsion unit as claimed in claim 1 wherein the position of the first aperture is selected so as to maximize the flow of gas over the spark plug when the first aperture is open.

4. A marine propulsion unit as claimed in claim 1 wherein the first aperture is provided in the combustion chamber.

5. A marine propulsion unit as claimed in claim 4 wherein the first aperture is substantially annular, and partially surrounds the spark plug.

6. A marine propulsion unit as claimed in claim 1 and further comprising an openable second aperture, the second aperture being positioned such that, in its open state, movement of the piston causes fluid within the propulsion unit to pass out through the second aperture.

7. A marine propulsion unit as claimed in claim 6 wherein the second aperture is disposed at substantially the most efficient drainage point of the propulsion unit.

8. A marine propulsion unit as claimed in claim 6 and further comprising a crank-case extending from a second end of the cylinder; and a transfer passage for providing fluid communication between the crank-case and the combustion chamber; wherein the second aperture is provided in the transfer passage.

9. A marine propulsion unit as claimed in claim 8 and further comprising means for injecting fluid into the transfer passage through the second aperture.

10. A marine propulsion unit as claimed in claim 6 and further comprising control means for opening/closing the first and second apertures.

11. A marine propulsion unit as claimed in claim 10 wherein the control means is adapted to open the first aperture a pre-set time after opening the second aperture.

12. A marine propulsion unit as claimed in claim 10 wherein the control means is adapted to open the first aperture simultaneously with the second aperture.

13. An outboard motor comprising a marine propulsion unit as defined in claim 1.

14. A method of determining the position of the first aperture for a marine propulsion unit as defined in claim 1, the method comprising the steps of:

(a) determining a parameter indicative of the flow of gas over the spark plug when the first aperture is open for a first position of the first aperture;

(b) determining the value of the parameter for a second position of the first aperture; and (c) comparing the results of steps (a) and (b).

15. A method as claimed in claim 14 wherein the parameter is the rate of flow of gas over the spark plug.

16. A method as claimed in claim 14 wherein the parameter is the velocity of the flow of gas over the spark plug.

17. A method as claimed in claim 14 wherein the parameter is indicative of both the volume of flow of gas over the spark plug and the velocity of flow of gas over the spark plug.

18. A method of purging a marine propulsion unit, the propulsion unit comprising: a cylinder; a combustion chamber extending from a first end of the cylinder; a spark plug disposed within the combustion chamber; a piston reciprocably movable within the cylinder; and a first aperture, the first aperture being selectively openable independent of the position of the piston within the cylinder; the method comprising the steps of:

opening the first aperture; and reciprocating the piston within the cylinder so as to induce flow of gas over the spark plug thereby to remove water trapped within the spark plug.

19. A method of purging a marine propulsion unit as claimed in claim 18 wherein initial reciprocating of the piston expels water from the propulsion unit through the first aperture and further reciprocating of the piston induces flow of gas over the spark plug.

20. A method of purging a marine propulsion unit as claimed in claim 18, wherein the unit further comprises an openable second aperture, the method comprising:

opening the second aperture;

reciprocating the piston within the cylinder so as to expel water from the propulsion unit through the second aperture;

opening the first aperture; and further reciprocating the piston within the cylinder so as to induce flow of gas over the spark plug thereby to remove water trapped within the spark plug.

21. A method of purging a marine propulsion unit as claimed in claim 18, wherein the unit further comprises an openable second aperture, the method comprising:

opening the first and second apertures;

reciprocating the piston within the cylinder so as to expel water from the propulsion unit through the first and second apertures and so as to induce flow of gas over the spark plug thereby to remove water trapped within the spark plug.

22. A method of re-starting a marine propulsion unit, the method comprising the steps of:

purging the marine propulsion unit as defined in claim 20; and introducing a starting aid into the marine propulsion unit through the second aperture.

23. A method of re-starting a marine propulsion unit, the method comprising the steps of:

purging the marine propulsion unit as defined in claim 21; and introducing a starting aid into the marine propulsion unit through the second aperture.

24. A method of starting a marine propulsion unit comprising the steps of:

supplying a first fuel to the marine propulsion unit;

starting the marine propulsion unit;

stopping the supply of the first fuel;

supplying a second fuel different from the first fuel to the marine propulsion unit; and providing a marine propulsion unit comprising a cylinder, a combustion chamber extending from a first end of the cylinder, a spark plug disposed within the combustion chamber, and a piston reciprocably movable within the cylinder, a first aperture, the first aperture being selectively openable independent of the position of the piston within the cylinder, the first aperture being positioned such that, in its open state, movement of the piston causes gas within the propulsion unit to flow over the spark plug thereby to remove water from the spark plug, and an openable second aperture, the second aperture being positioned such that, in its open state, movement of the piston causes fluid within the propulsion unit to pass out through the second aperture, wherein the method comprises supplying the first fuel through the second aperture.

* * * * *